United States Patent [19]

Kanai et al.

[11] Patent Number: 4,860,044

[45] Date of Patent: Aug. 22, 1989

[54] PHOTOGRAPHIC MATERIAL PROCESSING UNIT

[75] Inventors: Kunio Kanai; Toshiyuki Yamamoto, both of Hino, Japan

[73] Assignee: Konishiroku Photo Industry Co., Ltd., Tokyo, Japan

[21] Appl. No.: 910,391

[22] Filed: Sep. 22, 1986

[30] Foreign Application Priority Data

| | | | |
|---|---|---|---|
| Sep. 30, 1985 | [JP] | Japan | 60-216940 |
| Oct. 3, 1985 | [JP] | Japan | 60-220855 |
| Oct. 4, 1985 | [JP] | Japan | 60-221258 |
| Oct. 4, 1985 | [JP] | Japan | 60-221260 |
| Oct. 4, 1985 | [JP] | Japan | 60-221262 |
| Oct. 4, 1985 | [JP] | Japan | 60-221263 |
| Dec. 18, 1985 | [JP] | Japan | 60-285306 |

[51] Int. Cl.[4] ..... G03D 3/08

[52] U.S. Cl. ..... 354/321; 354/322; 354/339; 226/92

[58] Field of Search ..... 354/316, 320, 321, 322, 354/328; 226/92

[56] References Cited

U.S. PATENT DOCUMENTS

| | | | |
|---|---|---|---|
| 2,770,179 | 11/1956 | Dye et al. | 354/320 |
| 4,131,356 | 12/1978 | Schmidt | 354/322 |
| 4,140,383 | 2/1979 | Schmidt | 354/316 |
| 4,575,209 | 3/1986 | Zwettler | 354/322 |
| 4,613,221 | 9/1986 | Takase et al. | 354/322 |

FOREIGN PATENT DOCUMENTS

| | | | |
|---|---|---|---|
| 2119122A | 9/1983 | United Kingdom | 354/321 |

*Primary Examiner*—A. A. Mathews

*Attorney, Agent, or Firm*—Bierman: Jordan B.

[57] ABSTRACT

The object of the present invention is to provide a small-sized photographic material processing unit of a simple structure capable of developing both disk film and roll film simultaneously or selectively. In order to attain this object, the present invention is characterized in that in the photographic material processing unit adopted to process the photographic material by allowing it pass through a processing tank containing a processing solution, the disk film and/or foll film are passed through the same processing tank while they are held by a carrier.

18 Claims, 19 Drawing Sheets

PHOTOGRAPHIC MATERIAL PROCESSING UNIT

BACKGROUND OF THE INVENTION

The present invention relates to a photographic material processing unit and more particularly to such type of unit that can process a sheet film shaped in a predetermined form and/or a web-shaped film which are now in general use, by allowing them to pass through the same processing tanks.

In order to process the above two kinds of photographic materials by a single photographic material processing unit, various kinds of proposals have hitherto been made. (For example, reference is made to the Japanese Patent Publication Open to Public Inspection No. 37542/1964).

The conventional photographic material processing unit has been of the type such that since the time of development differs between a disk film as a sheet film and a roll film as a web-shaped film and also since a number of disk films are supported by a film carrier or holder through their holes, the film carrier is carried as it is raised from each processing tank by which the films are processed.

However, the above structure has had disadvantages in although it can process a large amount of disk films effectively, the operation and structure for processing the disk films automatically are complicated and the entire unit itself must inevitably become large-sized.

SUMMARY OF THE INVENTION

The present invention has been made to overcome the abovementioned difficulties and the object of the present invention is to provide a small-sized photograph material processing unit of a comparatively simple structure capable, however, of developing both disk and roll films simultaneously or selectively.

In order to settle the above-mentioned problems, the present invention is characterized in that in the case of a photographic material processing unit adopted to process the photographic material by allowing it pass through processing tanks, the disk film and/or roll film are passed through the same processing tanks while they are held by a carrier means.

BRIEF DESCRIPTION OF THE INVENTION

FIG. 15 is a view showing the carrier means of FIG. 14 especially when roll films are attached thereto;

FIGS. 23 through 26 are views showing processing solution circulating means;

DESCRIPTION OF THE PREFERRED EMBODIMENTS

General Structure of the Present Invention

Figure 1:
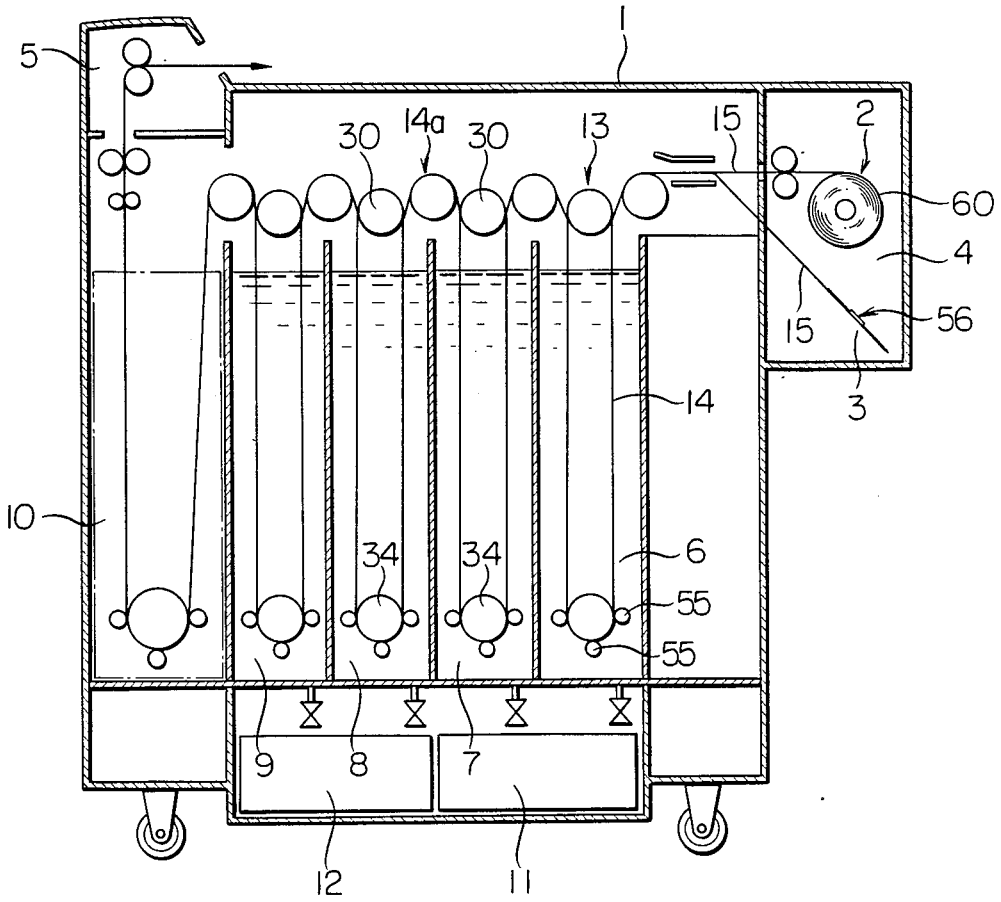
FIG. 1 is a schematic sectional view of a photographic material processing unit according to the present invention.

In FIG. 1, reference numeral 1 designates a body of a photographic material processing unit capable of shielding light from outside. On one side of the body 1 there is provided a photographic material supply section 4 as a supply means comprising a roll film supply section 2 and a disk film supply section 3 while a photographic material takeout section 5 is as a delivery means provided on the other side. Between the photographic material supply section 4 and the photographic material takeout section 5, that is, the internal area of the unit 1, there are arranged in sequence and adjacent to one another a developing tank 6, a bleaching tank 7, fixing tank 8, a rinsing or stabilizing tank 9 and a drying section 10 and in these tanks predetermined amounts of processing solutions are stored.

It should be noted that the above processing tanks may include a developing tank, a bleaching stabilizing tank and a rinsing or stabilizing tank.

At the lower part of the processing tank, there are arranged waste solution tanks 11 and 12 so as to store an overflowed waste solution therein. Further, the waste solution may be discharged outside instead of storing it within the unit.

The photographic material is conveyed into the processing tank by a convey means comprising a film carrying path and a carrier means.

Namely, throughout the distance from the photographic material supply section 4 to the photographic material takeout section 5 via the developing tank 6, the bleaching tank 7, the stabilizing tank 8, the rinsing or stabilizing tank 9 and the drying section 10, there is formed the film carrying path 14 by means of a conveying mechanism 13 and the photographic material is carried along the path 14 by the carrier means 15.

Figure 2:
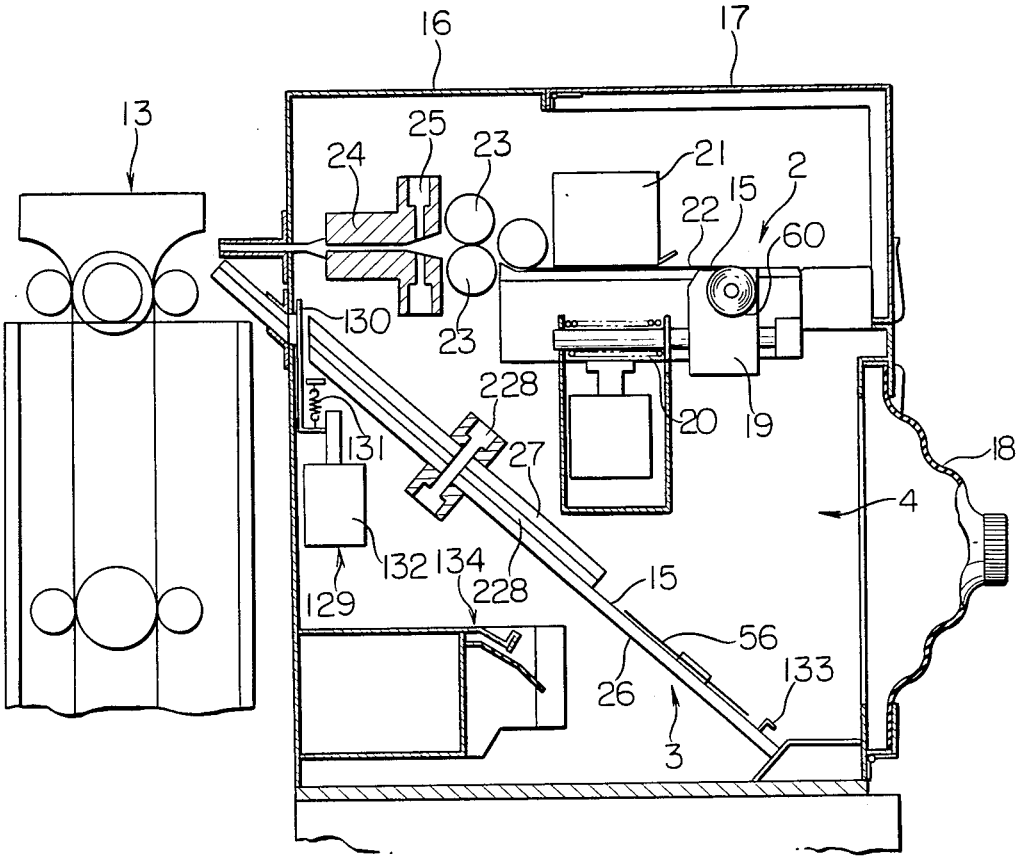
FIG. 2 is a sectional view of a photographic material supply section of the unit of FIG. 1.

The photographic material supply section 4 is arranged within a set box 16 as shown in FIG. 2 which box is provided with a cover 17 at the upper part, and a dark bag 18 at the side part, thereof. To set the photographic material into the set box 16, the cover 17 is opened or the material is inserted into the box 16 by hand through the dark bag 18.

The roll film supply section 2 is arranged such that a holder support 19 of the section 2 can move in the horizontal direction through a spring 20 and in front of the holder support 19, there is formed a carrier means inserting section 22 between the support 19 and a cutter section 21. Further, in front of the film cutter section 21, there are arranged a light shielding roller 23 and an insert guide section 24 which latter is provided with a sensor 25 for detecting the passing of the roll film.

Further, the disk film supply section 3 is so arranged that the top end of its carrier set portion 26 extends toward the fore end of the roll film section by passing through the side of the set box 16. The carrier set portion 26 is provided with an insert guide 27 thereby forming a carrier transfer path 28.

Inside the set box 16, there is arranged a light shielding means 129 whose shutter 130 is slidable with respect to the set box 16 so as to open and close the carrier transfer path 28. The shutter 130 is constantly energized toward its closing direction by means of a return spring 131 and has at its one end a solenoid 132 coupled thereto. The solenoid 132 opens the shutter 130 against the return spring 131 when the disk film is carried, and closes when the cover 17 or the dark bag 18 of the set box 16 is opened.

To the carrier set portion 26 there is fixed a carrier set pin 133 which acts as a fitting mechanism and the carrier means 15 is attached to the carrier set pin 133.

At the lower part of the carrier set portion 26, there is provided a disk film removing section 134 through which the disk film received within a package is taken out and the disk film is detachably attached to the carrier means through a fitting means.

Figure 3:
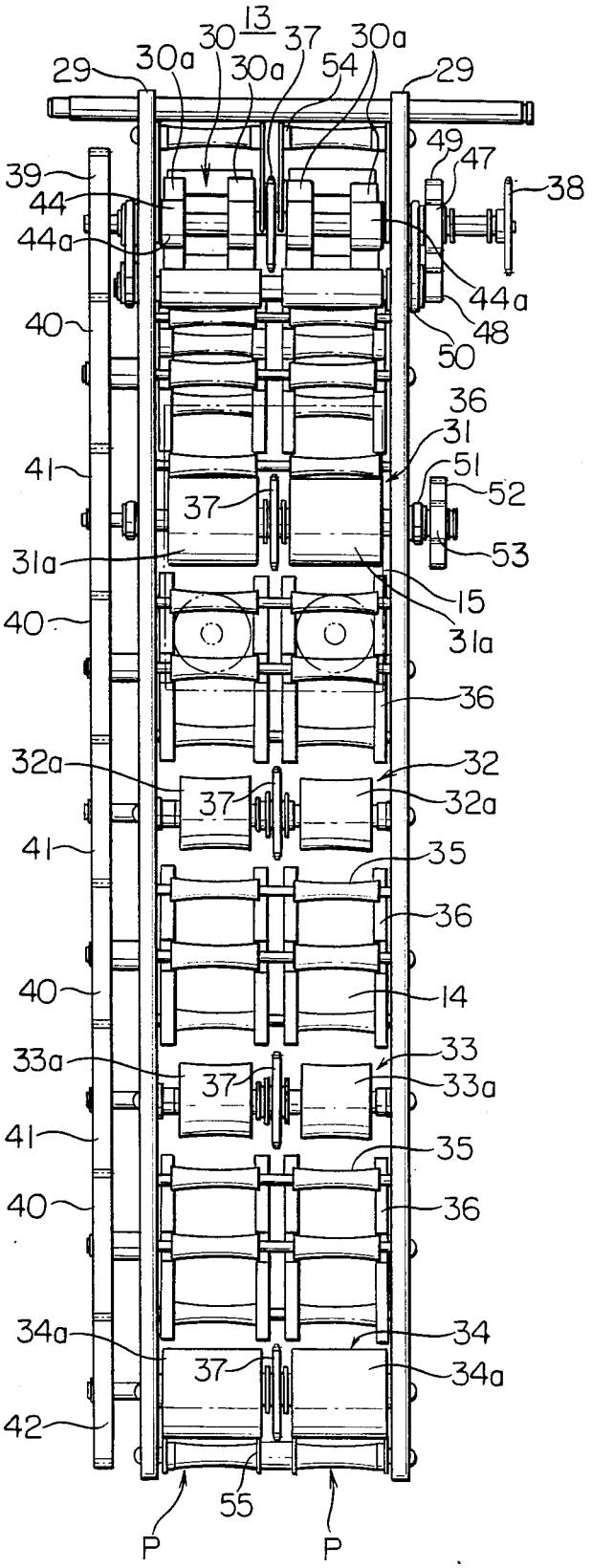
FIG. 3 is a side view of a film conveying mechanism.
Figure 4:
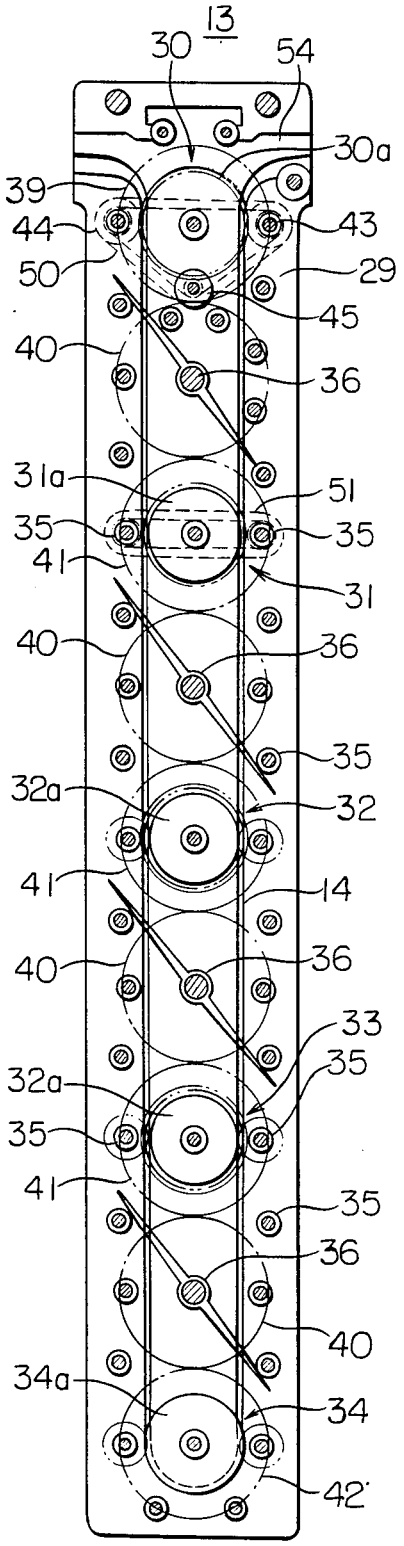
FIG. 4 is a sectional view of the film conveying mechanism of FIG. 3.
Figure 5:
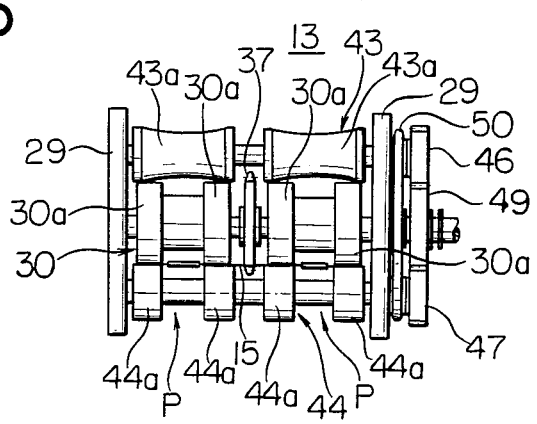
FIG. 5 is a plane view of the film conveying mechanism.

The conveying mechanism 13 is formed as shown in FIGS. 3 through 5.

On a pair of rack side plates 29, there are arranged upper rollers 30, intermediate rollers 31, 32 and 33, lower rollers 34 and guide rollers 35 and the carrier means 15 is conveyed by these rolelrs. Between the upper rollers 30, and the intermediate rollers 31 through 33 and between the interroller 33 and the lower roller 34, there are arranged film guides 35, respectively, so that the variation of the film in the cross direction is prevented.

The carrier means 15 is conveyed by means of conveying sprockets 17 provided for the upper rollers 30, the intermediate rollers 31, 32 and 33 and the lower rollers 34. These rollers 30 through 34 include roller sections **30*a*, 31*a*, 32*a*, 33*a* and 34*a*, respectively, on both sides of the conveying sprockets 37 whereby film carrying path 14** is formed.

The film carrying path 14 can performs as a common path capable of passing a disk film and a roll film.

On one end of the upper roller 30, there is provided a drive sprocket 38 which is connected to a drive motor through an endless power transmitting means such as a chain (not shown).

On the other end of the upper roller 30, there is provided an output gear 39 which meshes with a linkage gear 40 provided on the film guide 36 so that a driving power is transmitted to a linkage gear 41, the linkage gear 30 and a linkage gear 42 provided on the intermediate rollers 31, 32, 33, the film guide 36 and the lower roller 34, so as to rotate the intermediate roller 31, 32 and 33 and the lower roller 34 in sequence.

Around the upper roller 30, there are provided small rollers 43, 44 and 45 which are arranged on the inlet side, outlet side and lower side of the roller 30 and gears 46, 47 and 48 provided on one side of these rollers mesh with a gear 49 of the upper roller 30 so as to rotate by interlocking with the roller 30.

These small rollers 43, 44 and 45 are retained by a predetermined load exerted by a compression spring 50. The disk film and the roll film attached to the carrier means 15 are introduced between the roller sections **43*a* of the inlet side small roller 43 and the roller sections 30*a* of the upper roller 30, and discharged from between the roller sections 44*a* of the discharge side small roller 44 and the roller sections 30*a***.

The intermediate roller 31 located upward is held by the guide roller 35 and the compression spring 51 arranged on both sides thereof and a gear 52 of the intermediate roller 31 and a gear 53 of the guide roller 35 mesh with each other to rotate interlockingly.

At a portion above the upper roller 31, there is arranged an upper guide 54 by which the carrier means 15 is guided to be introduced and discharged. Similiarly, a lower guide 55 is arranged below the lower roller 34 and guides the carrier means 15 to return.

The carrier means 15 is formed as shown in FIGS. 6 through 9.

Figure 6:
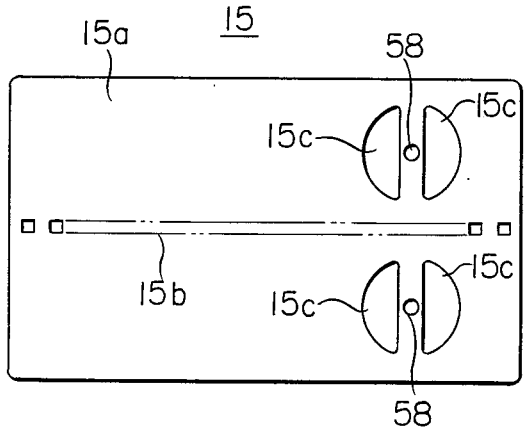
FIG. 6 is a front view of a carrier means.

FIG. 6 shows a front view of the carrier means 15 comprising a body **15*a* provided with an engaging slot 15*b* which engages the sprocket 37. At the rear part of the body 15*a* in the carrying direction, the disk films 56 are held by a fitting means 57 as a first fitting means at positions across the engaging slot 15*b*** in symmetrical relationship with each other.

The fitting means 57 is formed of a receiving member 58 formed integral with the carrier body 15*a* and a setting member 59 capable of engaging with the receiving member 58. Further, the setting member 59 has a base plate 59*a* which is larger in diameter than the receiving member 58 and an engaging projection 59*b* at the center thereof.

The disk film 56 is held by the carrier means 15 in such a manner that a fitting hole 56*b* formed at a core section 56*a* of the disk film 56 is inserted into the receiving member 58 and the engaging projection 59*b* of the setting member 59 is brought into engagement with the engaging hole 58*a* of the receiving member 58 thereby fixing the disk film 56 onto the carrier means 15.

Around the fitting means 57, there are formed substantially semi-circular guide holes 15*c* in opposite relationship with each other with the diameter of each of the holes being larger than the outer dimension of the disk film 56 attached thereto. These guide holes prevent the carrier means 15 from interferring with the disk film 56 when the carrier means 15 advances in a curved state.

Around rear end of the carrier means 15 in the carrying direction, there is attached a roll film 60 with a tape 61 applied to the fore end thereof.

Next, the operation of the instant embodiment will be described.

To process the disk film 56, the engaging hole 15*b* of the carrier means 15 is fixed to the carrier setting pin 133 by hand through the dark bag 18. Then the disk film 56 received within a package is taken out through the disk film takeout section 134 and attached to the carrier means 15 by the fitting means.

Then the carrier means 15 is removed from the carrier means setting pin 133 and the fore end of the carrier means 15 is inserted up to a predetermined position thereby carrying the film. In this case, the shutter 130 is opened by operating the solenoid 132 so that the disk film 56 is carried through the carrier means 15. Thus the fore end of the carrier means 15 is guided by the upper guide 54 and the engaging hole 15*b* of the carrier means 15 engages the sprocket 37 provided on the upper roller 30. As a result, the carrier means 15 is automatically drawn into the processing tank and conveyed by the intermediate rollers 31, 32, 33 and the sprocket 37 of the lower roller 34. Then the carrier means is returned under the guidance of the lower guide 55 and then discharged into the next processing tank from the upper guide 54.

The carrier means 15 is further introduced into the processing tank in the next step in the same manner as the above.

Figure 7:
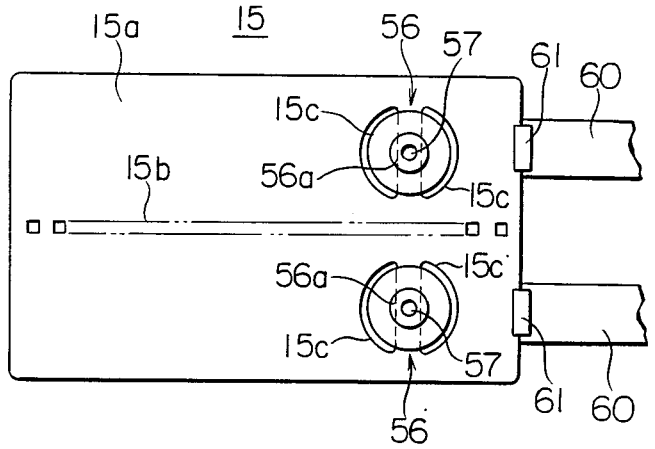
FIG. 7 is a front view of the carrier means having disk films attached thereon.
Figure 8:
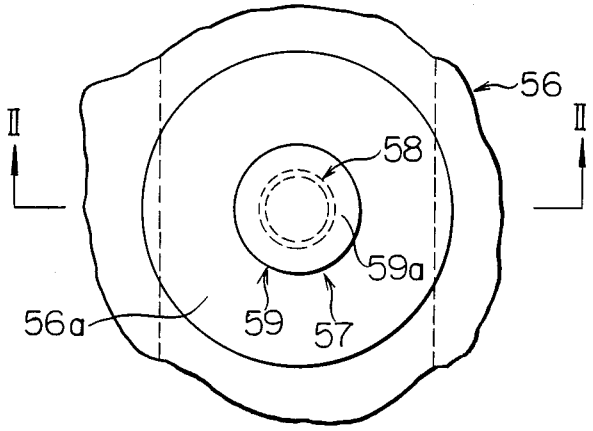
FIG. 8 is an enlarged front view of an essential part of the film attached section of the carrier means of FIG. 7.

Further, in case the roll film 60 is processed, the fitting means 57 is removed from the carrier means and as shown in FIG. 7, the roll film 60 is attached to the rear end of the carrier means 15 with a tape 61 as a second fitting means. Then the roll film 60 on the carrier means 15 is set in the holder support 19 and the carrier means 15 is thrusted forward by hand so that it is conveyed automatically.

Concrete Structure of Carrier Means

One example of the structure of the carrier means has been illustrated in FIGS. 6, 7, 8 and 9, another embodiment thereof will be additionally described hereunder.

Figure 10:
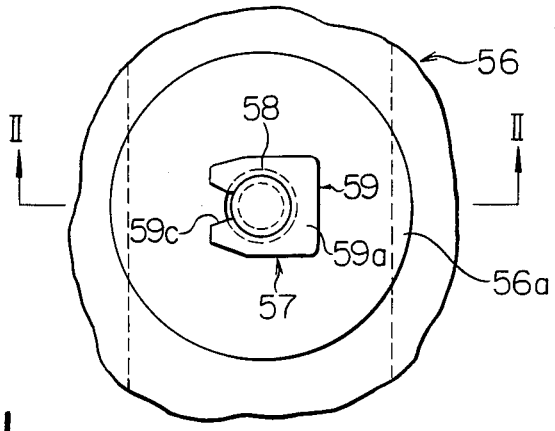
FIG. 10 is an enlarged front view of an essential part of another embodiment of the present invention.
Figure 11:
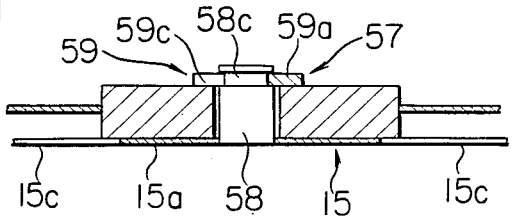
FIG. 11 is a sectional view taken along the XI—XI line of FIG. 10.

FIGS. 10 and 11 illustrate another embodiment of a carrier means wherein the receiving section 58 of the fitting means 57 is in the form of a shaft having an engaging groove 58*c* at its one end and the base plate 59*a* of the setting member 59 is provided with a recess 59*c*.

In case the disk film 56 is attached to the carrier means, the fitting hole 56*b* of the disk film 56 is fitted about the receiving member 58 and the recess 59*c* of the setting member 59 is caused to engage the engaging groove 58*c* of the memebr 58.

Figure 12:
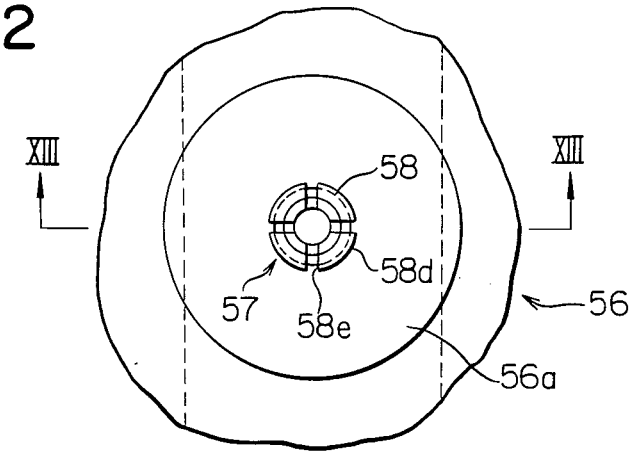
FIG. 12 is an enlarged front view of an essential part of still another embodiment of the present invention.
Figure 13:
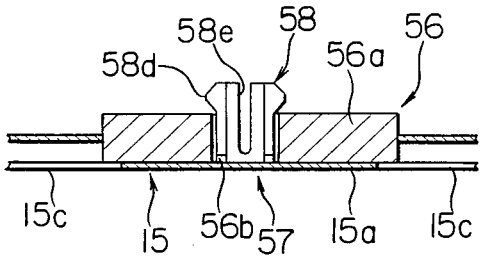
FIG. 13 is a sectional view taken along the XIII–XIII line of FIG. 12.

FIGS. 12 and 13 show still another embodiment of the carrier means according to the present invention. In this embodiment, the receiving member 58 is made circular and the top end thereof is formed to have an engaging section 58*d* projecting outward. Further, the member 58 is provided with recesses 58*e* formed at four positions in symmetrical relationships with one another.

Accordingly, when the fitting hole 56*b* of the disk film 56 is inserted about the receiving member 58 from upper side the film is fitted about the receiving member 58 since the diameter of the member 58 is made smaller at the recess 58*e*. Upon completion of fitting of the disk film 56 about the receiving member 58, the receiving member 58 returns to its initial state and the engaging section 58*d* stops the core section 56*a* of the disk film 56 thereby preventing the film from slipping out of the receiving member.

Figure 14:
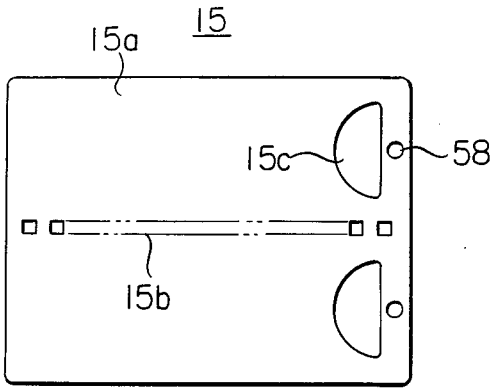
FIGS. 14 and 15 are views showing another embodiment of the carrier means according to the present invention.
Figure 15:
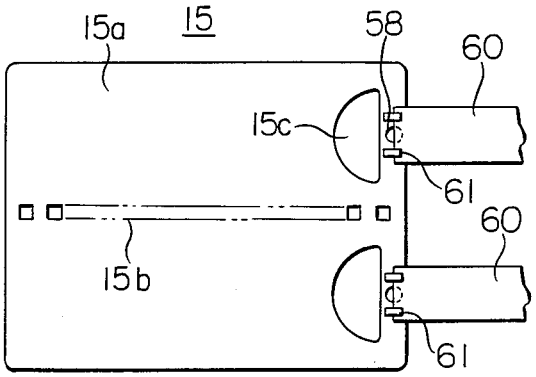

FIGS. 14 and 15 show a further embodiment of the carrier means according to the present invention. In the case of this embodiment, the receiving member 58 of the fitting means 57 is formed rearwardly of the body 15*a* of the carrier means 15 and therefore, when the roll film 60 is attached to the carrier means, the fitting position of the film is identical with that of the disk film 56 so that it is not possible to attach both of the films simultaneously.

Figure 16:
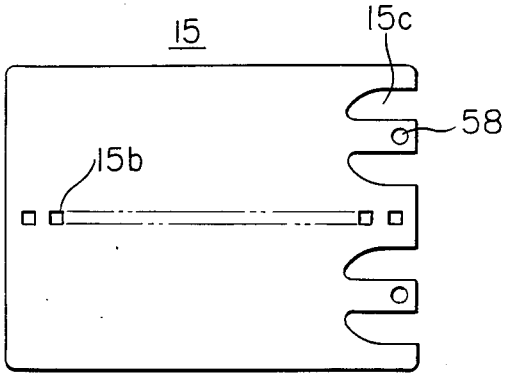
FIG. 16 is a front view of still another embodiment of the carrier means according to the present invention.

FIG. 16 show a still further embodiment of a carrier means 15 wherein the receiving section 58 of the fitting means 57 is formed at the back of the body 15*a* of the carrier means 15 and the guide holes 15*c* are formed on both sides of the receiving member 58 in the film carrying direction.

Figure 17:
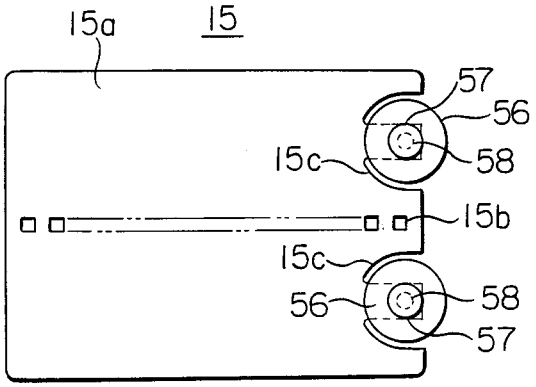
FIG. 17 is a view showing the carrier means of FIG. 16 especially when disk films are attached thereto.
Figure 18:
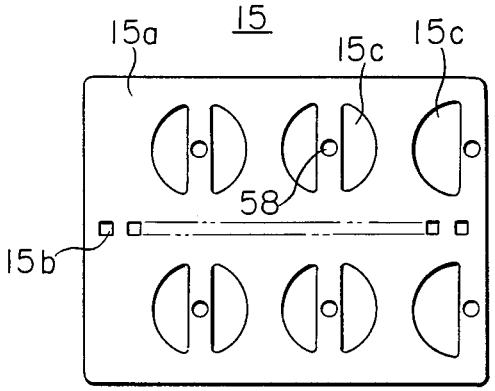
FIG. 18 is a view showing an embodiment of a carrier means having a plurality of disk films attached thereto.

FIG. 17 is a view showing a state in which the disk film is attached to the carrier means shown in FIG. 16 and FIG. 18 is a view showing an embodiment of a carrier means wherein the carrier means 15 is provided with a plurality of receiving members 58 of the fitting means 57 on the entire surface thereof so that a number of disk films 56 are held by the carrier means.

Figure 9:
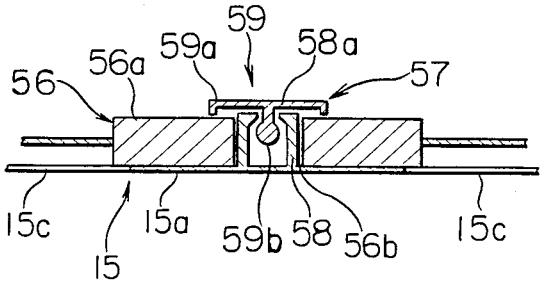
FIG. 9 is a sectional view taken along IX—IX line of FIG. 8.
Figure 19:
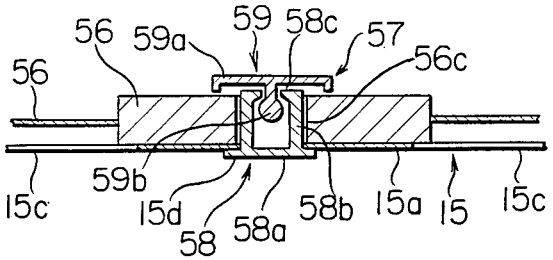
FIGS. 19 through 21 are views, respectively, each showing a structure of the disk film fitting section shown in FIGS. 9, 11 and 13 wherein the section is removably mounted on the body of the carrier means.
Figure 20:
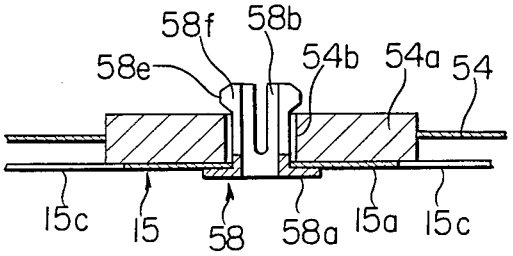
Figure 21:
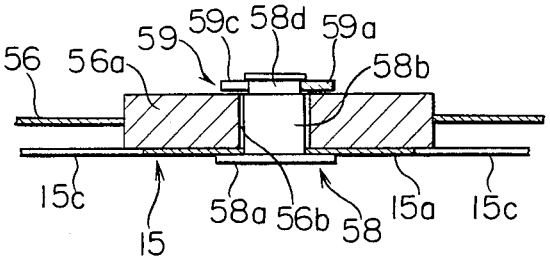

Various kinds of embodiments of fitting means having its receiving member 58 formed integral with the body 15*a* of the carrier means have been illustrated with reference to FIGS. 9, 11 and 13. However, it is of course possible to construct the fitting means in such a manner that as shown in FIGS. 19, 20 and 21, the receiving member 58 of the fitting means is engageable with the fitting hole 15*d* of the body 15*a* of the carrier means 15. That is, when processing the disk film, the film is attached to the carrier means by means of the fitting means and the carrier means with the film thereon the conveyed into the processing solution. Further, in case only the roll film is processed, the fitting means is removed from the carrier means and the roll film is attached to the carrier means which is then carried through the processing solution.

Thus, by making it possible to removably mount the fitting means on the body of the carrier means, the carrier means can be used for carrying both the disk film and the roll film so that it is possible to provide a carrier means for processing photographic material, which can be more easily controlled and which is excellent in operativity.

Next, when considering the passage of a disk film through a processing solution, if the carrier means and the image forming surface of the disk film is close to each other, there will be a possibility that the processing solution does not distribute uniformly on the entire surface of the image forming surface and development irregularities take place.

Figure 22:
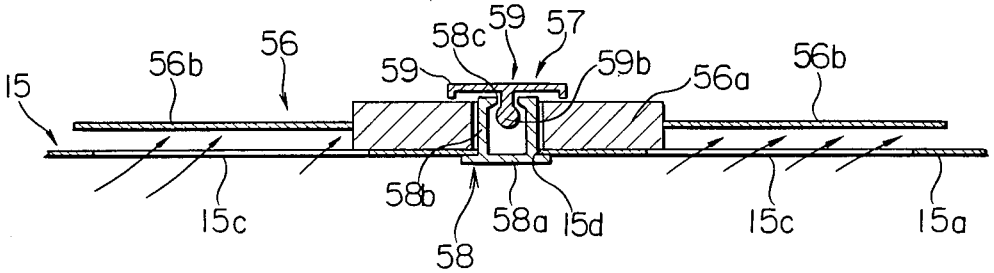
FIG. 22 is a view showing a state in which a processing solution circulates near the disk film fitting section.

To meet the above difficulty, the carrier means according to the present invention is provided with a processing solution circulating means at the disk film fitting section of the body thereof. That is, as shown in FIG. 6, the carrier means 15 has semi-circular guide holes 15*c* around the disk fitting hole 58 and as shown in FIG. 22, when the disk film 56 is carried through the processing solution by being guided by the carrier means 15, the processing solution flows into and out from the guide holes 15*c* so that the processing solution circuites smoothly over the image forming surface 56*b* of the disk film 56.

The disk film is carried in the like manner into the processing tank in the next step and the processing solution circulates uniformly over the image forming surface 56*a* of the film thereby reducing irregularities of development.

Further, even at the drying section in FIG. 1, dry air from the guide holes 15*c* blows uniformly over the image forming surface 56*a* reducing innregularities of development, too.

Figure 23:
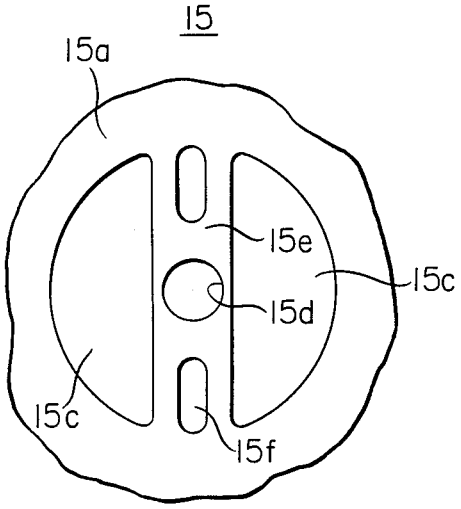
FIGS. 23 through 26 are views showing a processing solution circulating means.

FIGS. 23 through 26 show another embodiment of the processing solution circulating means for the carrier means wherein FIG. 23 shows a structure in which a portion 15*e* separating the guide holes 15*c* of the carrier means is provided with guide holes 15*f* so that the processing solution circulates more smoothly.

Figure 24:
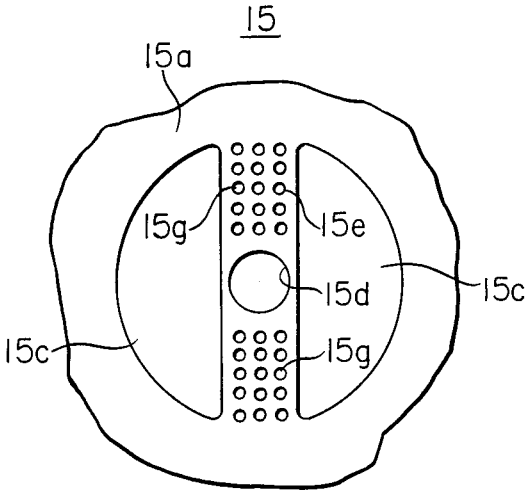

FIG. 24 shows a structure in which the above-mentioned portion 15*e* is provided with a number of small guide holes 15*g*.

Figure 25:
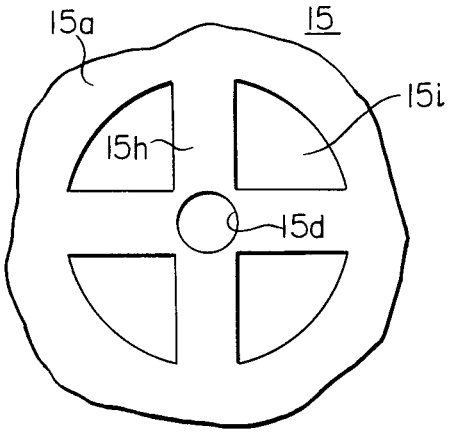

FIG. 25 shows a structure in which the body 15*a* of the carrier means 15 is provided with guide holes 15*i* leaving a cross section 15*h* in the body 15*a*.

Figure 26:
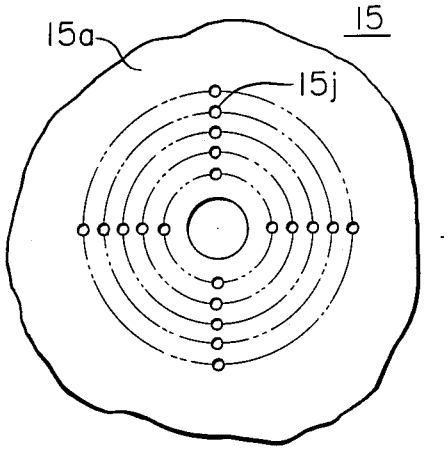

FIG. 26 shows a structure in which the body 15*a* of the carrier means 15 is provided with a number of small-diametered guide holes 15*j* in correspondence to the image forming surface 56*b* of the disk film 56.

Concrete Structure of Lower Roller Section

The disk film is in the form of a disk and is carried by the carrier means with its comparatively thick core portion at the center attached to the carrier means but there is a possibility that the film may turn away from the lower turning section of the film carrying path. To prevent this, the provision of a guide member at the lower turning section may be considered for the purpose of carrying the film smoothly under the guidance of that member. However, there is still a possibility that even when the film is carried in a regular manner, it is interferred with the guide member.

According to the present invention, when the disk film is deviated from the film carrying path at the lower turning section thereof, the film is carried by being guided by the guide means. Further, when the film is carried in a regular manner, it is carried smoothly without being interfered with the guide means.

That is, as shown in FIG. 1, the aforementioned film carrying mechanism 13 causes the photographic material to be returned by the lower roller 34 arranged at the lower part of the processing tank and then turned by a cross-over passage 14*a* arranged between the processing tank and the next processing tank.

Around the lower roller 34, the guide roller 55 acting as the guide means is arranged.

Figure 27:
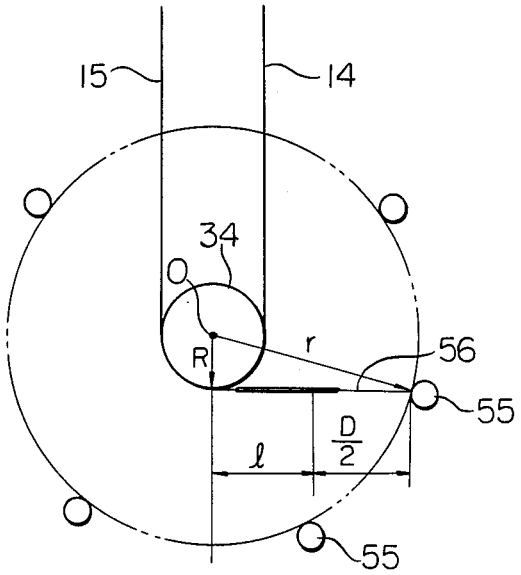
FIG. 27 is an enlarged view of one example of structure of a lower roller.

As shown in FIG. 17, when the disk film 56 is attached at the rear side of the body 15*a* of the carrier means with respect to the film carrying direction, the guide roller 55 guides the disk film when the film tends to deviate largely from the film carrying path as shown in FIG. 27 while when the film is carried in a regular manner, it allows the film to be carried without being interfered with the guide means.

The distance r between the center O of the lower roller and the peripheral surface of the guide roller 55 may be obtained by the following formula:

$$r > \sqrt{R^2 + (l + D/2)^2}$$

provided that R is the diameter of the lower roller 34; D is the diameter of the disk film 56; and l is the distance between the center of the disk fitting section of the carrier means 15 and the tip end of the recess 15*d*. For example, assuming that the radius R of the lower roller be 15 mm, the diameter of the disk film be 65 mm and the distance l between the center of the disk fitting section of the carrier means 15 and the tip end of the recess 15*c* be 35 mm, the distance r between the center of the lower roller 34 and the peripheral surface of the guide roller 55 may be determined longer than 69.2 mm.

Next, the operation of the instant embodiment will be described.

In case where the disk film 56 is processed, the fitting member 57 is inserted into the disk fitting hole 15*d* of the carrier means 15, the disk film 56 is attached to the carrier means 15 which is then set at the film supply section 3. The carrier means 15 operates such that it is conveyed along the film carrying path as the sprocket 37 of the conveying mechanism 13 in FIG. 3 comes into engagement with the engaging hole 15*b* of the carrier means, caused to return by means of the lower roller 34 and then discharged into the next processing tank through the upper roller 30.

The carrier means 15 is conveyed in the similar manner in the processing tank for the next processing step, too, whereby the disk film is processed.

When the carrier means 15 which is being conveyed along the film carrying path provided in the conveying mechanism 13 is caused to turn by the lower roller 34, it is conveyed without the end of the film 56 being interfered with the guide roller 55 even though the carrier means 15 bends in the tangential direction of the lower roller 34 as shown in FIG. 27.

Further, when the disk film 56 is so large that it tends to deviate outwardly of the film carrying path, it is brought into contact with the guide roller 55 and therefore, the film does not become bruised nor is it unfavorably carried.

Figure 28:
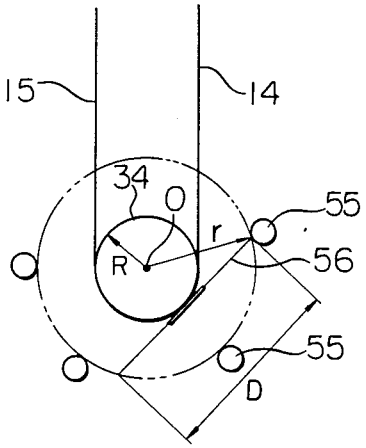
FIG. 28 is an enlarged view of another example of structure of the lower roller.

FIG. 28 shows another embodiment of the lower roller section according to the present invention wherein the disk film 56 is attached to the carrier means 15 as shown in FIG. 7. That is, the disk film 56 is attached to the position behind the center of the body 15*a* of the carrier means 15 in such a manner that the outer periphery of the disk film does not extend beyond the body 15*a* of the carrier means.

Thus, when the disk film 56 is carried by such carrier means 15, the film 56 inclines at the film fitting section in the tangential direction of the lower roller 34 when the carrier means 15 is caused to turn by the lower roller 34 as shown in FIG. 28. Accordingly, the distance r between the center O of the lower roller and the outer periphery of the guide roller 55 can be obtained by the following formula:

$$r > \sqrt{R^2 + (D/2)^2}$$

provided that R is the radius of the disk film and D is the diameter of the disk film 56.

For example, assuming that the radius R of the lower roller 34 be 15 mm and the diameter D of the disk film 55 be 65 mm, the distance r between the center 0 of the lower roller 34 and the peripheral surface of the guide roller 55 will be determined to be longer than 35.8 mm.

It should be noted that although the instant embodiment has been described in respect of a case in which it is applied to a photographic material processing unit capable of processing a roll film at the same time, it can also be applied to a photographic material processing unit used exclusively for processing a disk film.

Concrete Structure of Upper Roller Section

The photographic material processing unit according to the present invention is provided with squeeze rollers arranged at the film carrying path under a predetermined compression force so as to squeeze the photographic material lest the processing solution attached to the material should be carried into the processing tank for the next step. Now, when the disk film which is different in shape from the roll film and which has a comparatively thick core is carried, it is difficult for the former film to pass through the squeeze rollers in the same manner as the latter film so that the former film is liable to be bruised.

To solve the above problems, it is possible with the present invention to provide a releasing means for a photographic material processing unit capable of processing a disk film and a roll film by carrying them into the same processing tank, said releasing means releasing the compressing force of squeeze rollers arranged on the film carrying path at the time of carrying the disk film.

Figure 29:
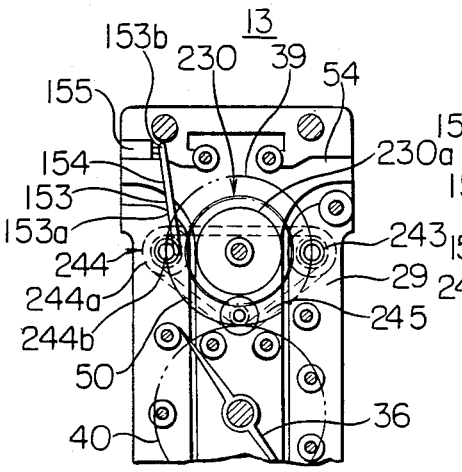
FIG. 29 through 31 are side, sectional and plane views, respectively, of a structure of an upper roller.
Figure 30:
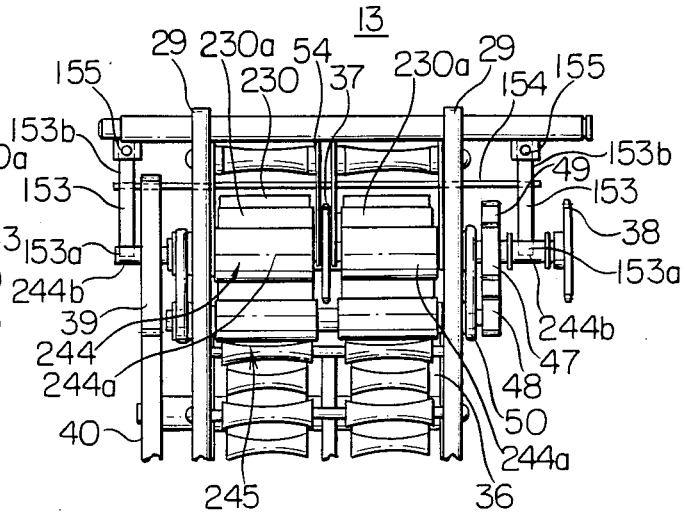
Figure 31:
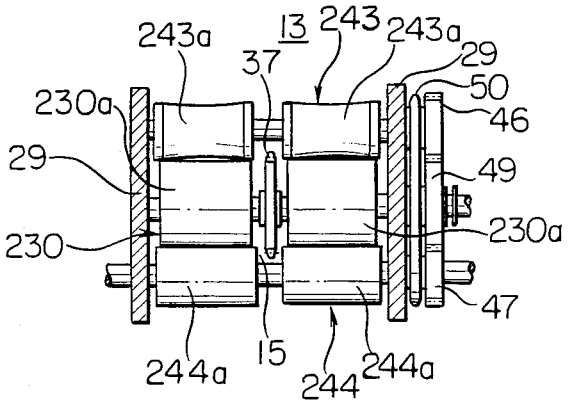

In the instant embodiment, the structure around the upper roller 30 shown in FIGS. 3, 4 and 5 is made as shown in FIGS. 29, 30 and 31.

Small rollers 243, 244 and 245 are held by a predetermined load applied by compression springs 50. The disk film 56 attached to the carrier means 15 or roll film 60 are carried in from between roller sections 243*a* of the inner side small rollers 243 and roller sections 230*a* of upper rollers 230 and carried out from between roller sections 244*a* of the outlet side small rollers 244 and roller sections 230*a* of the upper roller 230 while the processing solution adhered to the film is squeezed out. That is, between the small roller 243 and the upper roller 230 there is a clearance sufficient to allow the thick core portion of the disk film 56 to pass therethrough while the small roller 244 and the upper roller 230 are in close contact with each other so that the processing solution is squeezed out when the roll film passes therethrough.

At both ends 244*b* of the axis of the outlet side small roller 244 there are provided movable levers 153 whose ends 153*a* are in contact with the ends 244*b*, respectively. The movable levers 53 as a member of the realeasing means are rotatably supported by the rack side plates 29 through a support shaft 154 and the other end is coupled to a solenoid 155. When the solenoid 155 operates to rotate the movable lever 153 in the clockwise direction as in FIG. 21, the axial ends 244 of the outlet side small rollers 244 are thrusted outward against the compression springs 50.

Figure 32:
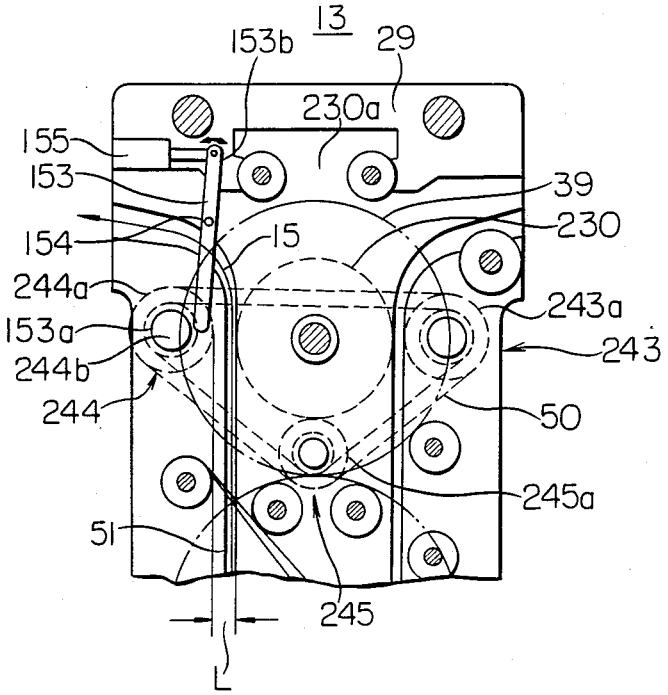
FIG. 32 is an enlarged view showing how an upper roller releasing means operates.

Accordingly, a clearance L is formed between the roller section 244*a* of the outlet side small roller 244 and the roller section 230*a* of the upper roller 230 as shown in FIG. 32 and the disk film 56 passes through this clearance. The solenoid 155 operates when a sensor 228 arranged in the photographic material supply section shown in FIG. 2 detects the passing of the disk film 56. The sensor 228 may be arranged at a suitable position on the conveying mechanism 13, for example.

In the instant embodiment, the carrier means 15 is set in the film supply section 3 through the drak bag 18. When the carrier means 15 is conveyed, the sensor 228 detects it, calculates the carrying speed and distance, operates the solenoid 155 before the arrival of the carrier means 15 and rotates the movable levers 153 in the clockwise direction. As a result, the outlet side small roller 244 is thrusted outward against the compression springs 50 to leave a clearance between the roller section 244*a* of the outlet side small roller 244 and the roller section 230*a* of the upper roller 230 so that the disk film 56 is allowed to be carried.

The transfer of the carrier means 15 into the processing tank is performed such that the fore end of the carrier means 15 is guided by the upper guide 59, the engaging hole 15*b* of the carrier means 15 comes into engagement with the sprocket 37 provided on the upper roller 30 and the carrier means 15 passes between the roller section 230*a* of the upper roller 230 and the roller section 243*a* of the inlet side small roller 243 so as to be drawn into the processing tank automatically. Then the carrier means 15 is conveyed by the sprocket 37 of the intermediate rollers 31, 32 and 33 and the lower roller 34 shown in FIG. 3, caused to return by being guided by the lower guide 55 through the lower roller 34 and conveyed by the outlet side small roller 244.

In this case, as described in the foregoing, releasing means can be operated to release the compression force of squeeze rollers after passing a predetermined time period since the sensor 228 detects the film 56, the predetermined time period can be determined based on the carrying speed and the distance between the position of the sensor 228 and the position of the squeeze rollers, the clearance between the roller section 230*a* of the upper roller 230 and the roller section 244*a* of the outlet side small roller 244 becomes larger immediately before the arrival of the carrier means 15 over the small roller 244 so that the carrier means 15 is discharged into the next processing tank through the clearance. Although the disk film 56 has the core 56*a* of comparatively large thickness, it can be smoothly carried through the enlarged clearance.

The carrier means 15 is conveyed in the same manner also in the processing tank in the next step.

When the roll film 60 is carried, the sensor 228 detects it to prevent the operation of the solenoid 155 so that the roller film 60 passes between the roller section 244*a* of the outlet side small roller 244 and the rolelr section 230*a* of the upper roller 230 under compression whereby the processing solution is squeezed out.

It should be noted that although in the instant embodiment only the outlet side small roller 244 is made to act as the squeeze roller, the inlet side small roller 243 can also be made so. In this case, each of the rollers may be provided with a solenoid mechanism or it may be moved by a combination of a single solenoid and a link mechanism. Anyway, the present invention is not always limited to the instant embodiment.

Structure of Cross-over Passage between Plurality of Processing Tank

In case where disk films are processed in sequence through a film carrying path so formed as to process the disk films in a plurality of processing tanks, there is a possibility that the end of the disk film entering a cross-over passage through which the film is carried into one of the processing tanks interferes with the end of the disk going to another cross-over passage through which the film is carried away from that processing tank, or the film interferes with the carrying mechanism such as rollers.

Therefore, it is considered to enlarge the cross-over passage of the film carrying path but if it is made larger than as required, the unit will become large-sized by that degree.

Accordingly, in the case of the present invention, the cross-over passage of the film carrying path is formed as in the instant embodiment so that the disk film is carried smoothly and the unit is more miniaturized.

As shown in FIG. 1, the lower roller 34 is arranged at the lower part of each of the processing tanks and the upper rollers 30 is arranged above the processing tank. Further, between the upper rollers 30, there is provided a cross-over passage 14*a* of the film carrying path 14 along which a photographic material is carried from one to the next processing tank.

Figure 33:
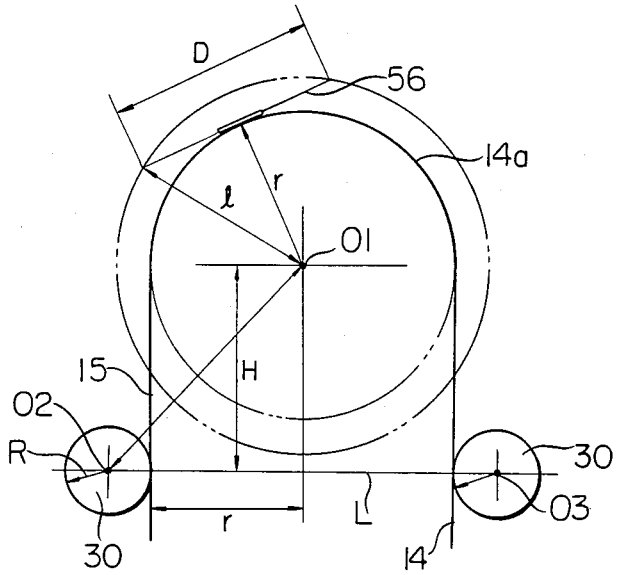
FIG. 33 is a schematic diagram of a cross-over passage defined between processing tanks.

As shown in FIG. 33, assuming that the radius of the cross-over section be r and the diameter of the disk film be D, the distance ( from the center 01 to the end of the disk film will be:

$$l=\sqrt{r^2+(D/2)^2}\ldots \quad (1).$$

Further, assuming that the radius of the upper roller be R, the radius r of the cross-over section will be:

$$R+r>l\ldots \quad (2).$$

and from the formula (2), $$r>(D^2/8\,R)-(R/2)\ldots \quad (3)$$

will result.

Now, the distance H between the line L connecting the centers 02 and 03 of the pair of upper rollers 30 will be expressed by:

$$H>\sqrt{(l+R)^2-(r+R)^2}\ldots \quad (4).$$

and when the formula (1) is substituted for the formula (4), $$H>\sqrt{(D/2)^2+2\,R\,(\sqrt{r^2+(D/2)^2}-r)}$$

will result.

Accordingly, the radius r of the cross-over passage of the film carrying path 14 is determined to satisfy the formula (3) and the distance H between the line connecting the centers 02 and 03 of the upper rollers and the center 01 of the crossover passage is determined to satisfy the formula (5) with the cross-over passage 14*a* formed small-sized.

For example, as a relation presented by $$R+r<l$$

does not satisfy the formula (3), there is a possibility that the disk film 56 leaving the cross-over passage 14*a* of the respective processing tank and the end of another disk film 56 entering the cross-over passage 14*a* of the next processing tank should interfere with each other.

Further, as a relation represented by $$H<\sqrt{(l+R)^2-(r+R)^2}$$

does not satisfy the formula (4), the end of the disk film 56 may comes into contact with the upper rolelrs 30.

Next, the operation of the instant embodiment will be described.

When the disk film 56 is processed, the fitting member 57 is inserted into the fitting hole 15*d* of the carrier means 15 and the disk film 56 is attached to the carrier means 15 which latter is then set in the disk film supply section 3. Then the sprocket 37 of the conveying mechanism 13 comes into engagement with the engaging hole 15*b* so that the carrier means 15 is carried along the carrying path 14, caused to return by the lower roller 34 and is carried into the next processing tank via the cross-over passage 14*a* of the carrying path 14.

Thus the carrier means 15 is carried in the same manner in the processing tank of the next step thereby processing the disk film.

In the case, the disk film 56 leaving the cross-over section 14*a* of the carrying path 14 is prevented from interfering with the end of another disk film 56 entering the crossover passage 14*a* of the next processing tank.

Further, the disk film 56 is carried with its end not interfering with the upper rollers so that the film is not bruised nor is it carried in an unfavorable manner.

It should be noted that although the instant embodiment has been described with respect to its application to a photographic material processing unit capable of processing roll films side by side with disk films, it can also be applied to that which is exclusively used for processing disk films.

Another Embodiment of Carrying Mechanism and Carrier Means Therefor

In the cases of the conveying mechanisms shown in FIGS. 3 through 5 and FIGS. 29 through 31, the common carrying path P which can be used for processing both disk and roll films simultaneously or selectively is formed but it is possible to form separate exclusive carrying paths for both films, respectively, and a preferred embodiment of such arrangement will now be described hereinbelow with reference to FIGS. 34 through 38.

Figure 34:
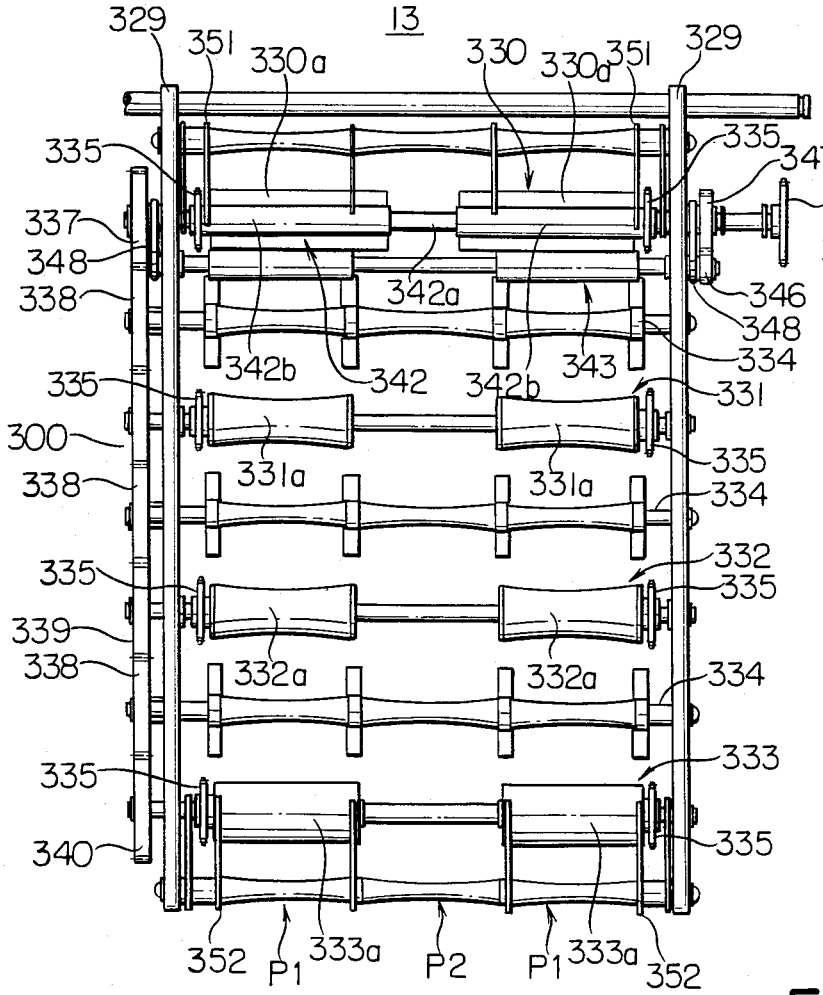
FIGS. 34 through 36 are side, sectional and plane views, respectively, of another embodiment of the film conveying mechanism according to the present invention.
Figure 35:
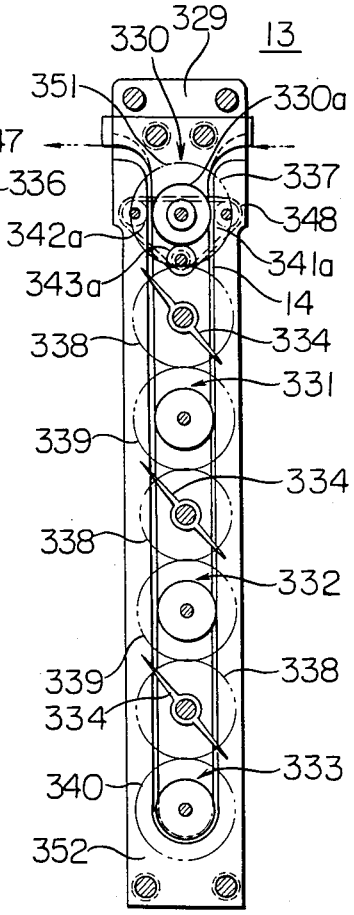
Figure 36:
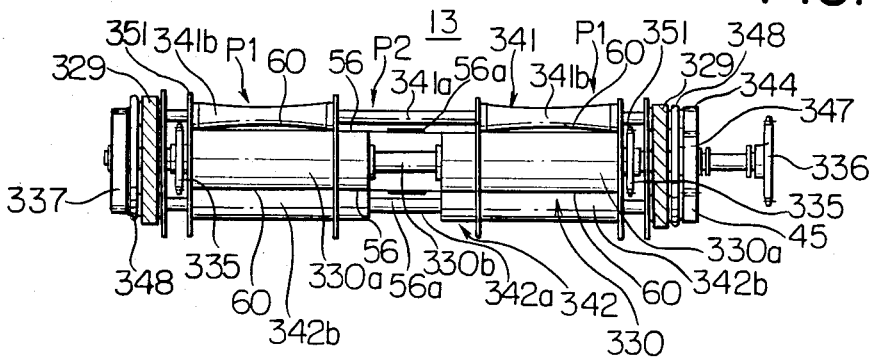

The carrying mechanism 13 according to the instant embodiment is formed as shown in FIGS. 34 through 36.

On a pair of rack side plates 329 there are mounted an upper roller 330, intermediate rollers 331 and 332 and a lower roller 333 and the film carrying passage 14 is formed through these rollers. Further, film guides 334 are arranged between the upper roller 330 and the intermediate roller 331, between the intermediate rollers 331 and 332 and between the intermediate roller 332 and the lower roller 334, respectively.

The carrier means 15 is conveyed by means of sprockets 335 provided on both ends of the upper roller 330, the intermediate rollers 331 and 332 and the lower roller 333. These rollers 330 through 333 are provided on both sides thereof with pairs of roller sections 330*a* through 333*a*, respectively, among which roll film carrying paths Pl as a first path are formed and between these roller sections there is provided a disk film carrying path P2 as a second path.

At one end of the upper roller 330 there is provided a drive sprocket 336 which is coupled to a drive motor through an endless power transmitting means such as a chain (not shown).

At the other end of the upper roller 330 there is provided an output gear 337 which meshes with linkage gears 338 mounted on the film guides 334 to transmit drive power to linkage gears 339, 338 and 340 provided on the film guides 334 and the lower roller 333 thereby rotating the film guides 334, the intermediate rollers 331 and 332 and the lower roller 333.

Further, around the upper roller 330 there are arranged inlet side, outlet side and lower side small rollers 341, 342 and 343 and gears 344, 345 and 346 provided on one end of these rollers mesh with a gear 347 of the upepr roller 330 so as to rotate in linkage with the upepr roller 330. The small rollers 341 through 343 are held by a predetermined load applied by compression springs 348 on both sides thereof and the disk film 56 attached to the carrier means 15 is carried from between the inlet side small roller 341 and the axial sections 341*a* and 330*b* with its core 56*a* passing there through and carried out from between the outelt side small roller 342 and the axial sections 342*a* and 330*b* of the upper roller 330.

Further, the roll film 60 attached to the carrier means 15 is introduced between the roller section 341*b* of the inlet side small roller 341 and the roller section 330*a* of the upper roller 330 and discharged out from between the 342*b* of the outlet side small roller 342 and the roller section 330*a* of the upper roller 330 while the processing solution attached to the film is squeezed out.

Figure 37:
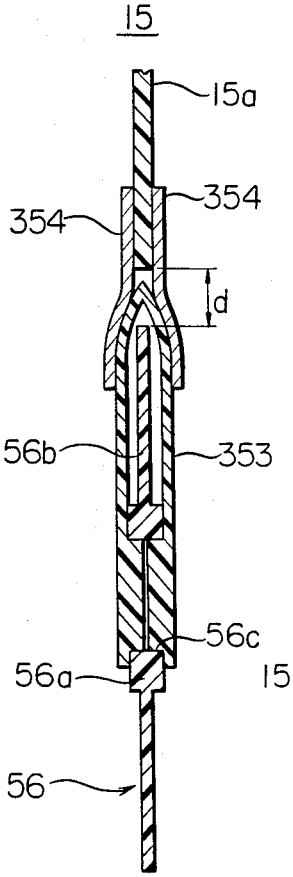
FIG. 37 is a front view of the carrier means used for the film conveying mechanism shown in FIG. 34.
Figure 38:
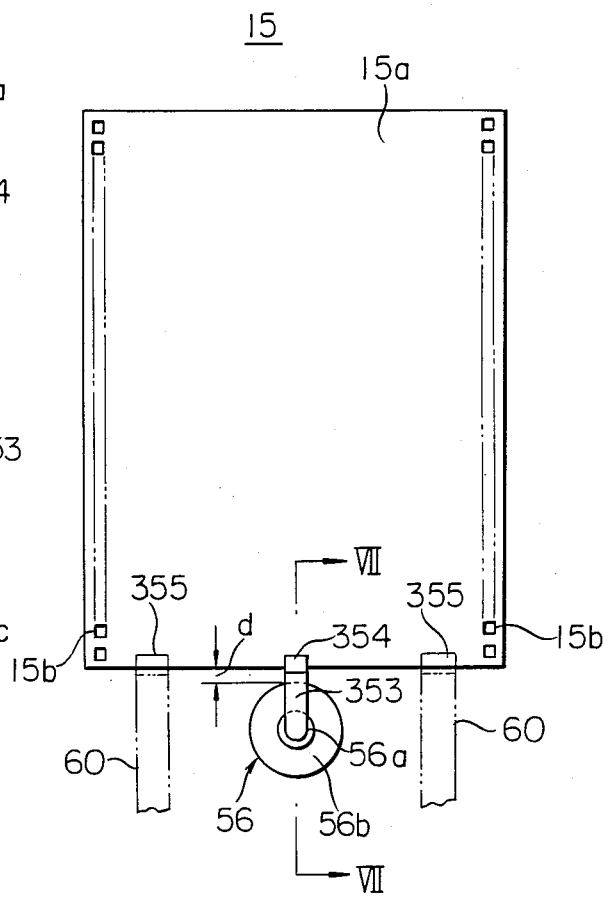
FIG. 38 is an enlarged sectional view of the disk film fitting section of the carrier means shown in FIG. 37.

At the upper portion of the upper roller 330, there are arranged upper guides 351 by which the introducing and discharging of the carrier means 15 are guided. Similiarly, there are arranged lower guides 352 at the lower part of the lower roller 333 so as to guide the carrier means 15 to return. The carrier means 15 in this conveying mechanism is formed as shown in FIGS. 37 and 38.

The carrier means 15 includes the body 15*a* which is provided with the engaging holes 15*b* on the both sides thereof and when the carrier means 15 is conveyed, the holes 15*b* come into engagement with the above-mentioned sprockets 335.

The body 15*a* of the carrier means 15 is attached with the disk film 56 at the rear end thereof with respect to the film carrying direction, especially at the center of the width of the body 15*a*.

The attachment of the disk film 56 to the carrier means 15 is performed in such a manner that a holding means 353 of synthetic resin material is mounted in the central hole 56*c* of the core 56*a* of the disk film 56 and he holding means is attached to the body 15*a* of the carrier means 15 by use of an adhesive tape 354.

The holding means 353 holds the disk film 56 so as to sandwich the image forming surface 56b from on both sides of the film. The length of the holding means 353 is about 55 mm as an one of preferred examples in this embodiment but it is not necessary to make it unnecessarily long only if it has a length d sufficient to prevent the disk film from coming into contact with the body 15*a*.

Further, it is desirable that the material of the holding means 353 is the same as the elastic carrier means 15. For example, when the carrier means 15 is made of polypropyrene, the holding means 353 may be made of polypropyrene, polyethylene, polystyrene, fluororesin, and so on whereby the carrier means 15 can turn smoothly at the return section of the film carrying path and does not hang down by the holding means 353 bending due to the weight of the disk film 56 when the carrier means 15 moves down along the film carrying path 14.

Further, due to the facts that the width of the holding means 353 is comparatively small being made of a flexible material and that the holding means 353 is spaced from the image forming surface 56*b*, the development of the part of the film facing inside the holding means is not hindered.

The carrier means 15 is attached with the roll film 60 at the rear part thereof with respect to the film carrying direction with the fore end of the film 60 fixed with, for example, a tape 353.

Next, the operation of the instant embodiment will be described.

In case the disk film 56 is processed, the film is fixed to the carrier means 15 at the photographic material supply section 4 shown in FIG. 2 by means of the holding means 353.

When the carrier means 15 is set in the disk film supply section 4 and thrusted by hand for carrying, the fore end of the carrier means 15 is guided by the upper guides 351 of the film carrying mechanism 13 shown in FIGS. 34 through 36 and the engaging holes 15*b* of the carrier means 15 engage the sprockets 335. As a result, the carrier means 15 is automatically drawn into the processing tank, conveyed by the sprockets 335 of the intermediate rollers 331, 332 and the lower roller 333, returned by being guided by the lower guides 352 at the lowr roller 333 and is finally discharged out from the upper guides 351 into the next processing tank.

The carrier means 15 is similiarly processed in the processing tank in the next step.

In this case, the disk film 56 which is attached to the carrier means 15 by the holding means 353 is carried smoothly along the disk film carrying path P2 formed in the film carrying path 14. Thus, the disk film 56 is carried in with its core 56*a* passed through the space between the shaft sections 341*a* of the inlet side small roller 341 and the shaft sections 330*b* of the upper roller 330 and is carried out from between the shaft sections 342*a* of the outlet side small roller 342 and the shaft sections 330*b* of the upper roller 330.

Further, in case only the roll film 60 is processed, only the roll film 60 is attached to the carrier means 15 and the latter is set in the roll film supply section 2 whereupon the carrier means 15 is conveyed along the film carrying path of the conveying mechanism in the same manner as aforementioned thereby developing the roll film.

It is also possible to carry both the disk film 56 and the roll film 60 simultaneously by attaching them to the carrier means 15. In this case, the carrier means 15 is, for example, set in the roll film supply section 2 instead of setting it in the disk film supply section 3 and when the carrier means attached with the disk film 56 passes that section, the light shielding roller 23 is raised thereby carrying the disk film smoothly.

Figure 39:
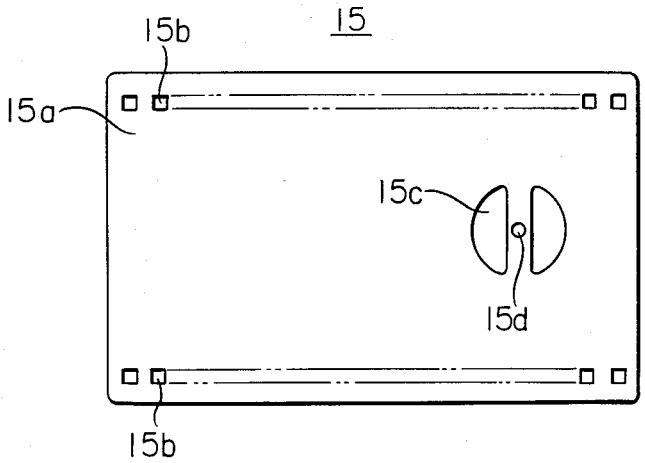
FIG. 39 is a view showing another embodiment of the carrier means used for the film conveying mechanism of FIG. 34.

Another embodiment of the carrier means for the film carrying mechanism according to the present invention is shown in FIG. 39.

FIG. 39 shows a front view of a carrier means 15 wherein the carrier means 15 comprises a body 15*a* having engaging holes 15*d* on both sides thereof. Further, at the rear of the body 15*a* of the carrier means with respect to the film carrying direction, there is formed a disk fitting hole 15*d* between the engaging holes 15*b* and around the hole 15*d* there are formed semicircular guide holes 15*c* for allowing the processing solution to circulate therethrough.

Figure 40:
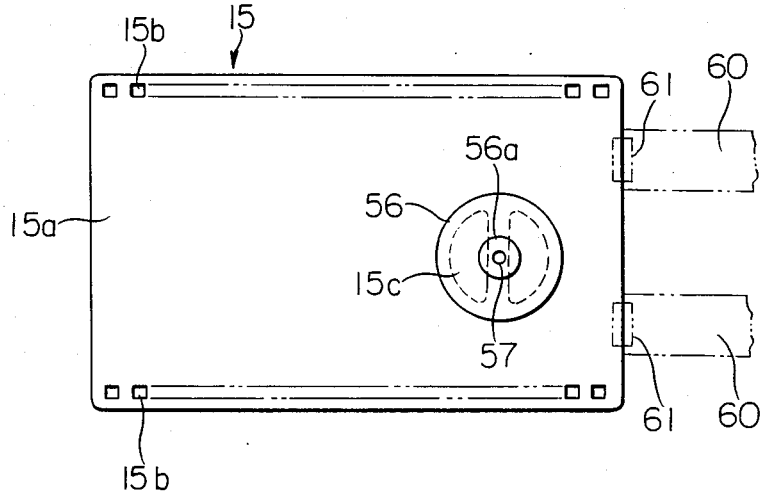
FIG. 40 is a view showing a state in which a photographic material is attached to the carrier means shown in FIG. 39.

FIG. 40 shows a state in which the disk film 56 and the roll film 60 are attached to the carrier means 15.

As regards the disk film fitting means, any of the methods shown in FIGS. 9, 11, 13, 19, 20 and 21 may be used. Preferred Embodiment of Disk Film Fitting Mechanism In the case of a photographic material processing unit of the type in which the disk film is attached to the carrier means outside the unit and the carrier means is set at a proper position on the photographic material supply section through a cover or a dark bag, the fitting operation is not conveniently performed. Therefore, in the case of the unit according to the present invention, a film fitting mechanism is provided at the photographic material supply section so as to attach the disk film to the carrier means as shown in FIG. 2.

Preferred embodiment of the film fitting mechanism will now be described with reference to FIGS. 41 through 44 which show a portion around the disk film fitting section of the mechanism shown in FIG. 2.

Figure 41:
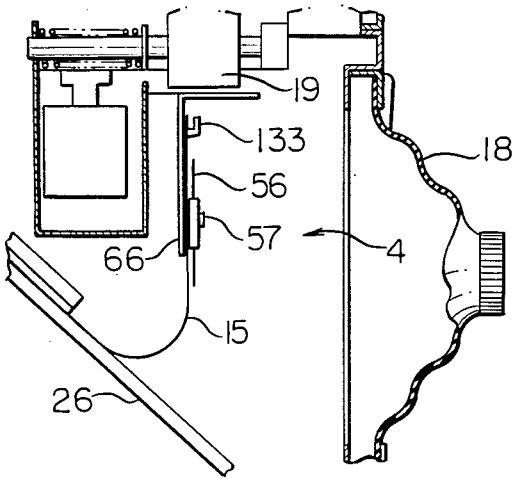
FIGS. 41 through 44 is a sectional view showing another embodiment of a disk film fitting mechanism.

The embodiment of FIG. 41 features that a support plate 66 is provided below the roll film supply section 2 and a carrier means set pin 133 is attached to the support plate.

The carrier means 15 is fixed to the set pin 133 and the disk film 56 is attached to the back side of the carrier means with the fitting means 57.

Accordingly, the disk film attached to the carrier means 15 is carried smoothly along the film carrying path in the film carrying mechanism 13 at the processing section with the film facing outward of the film carrying mechanism 13 and without the core 56*a* of the film coming into contact with the upper roller 30, the intermediate rollers 31, 32 and 33 and the lower roller 34.

Figure 42:
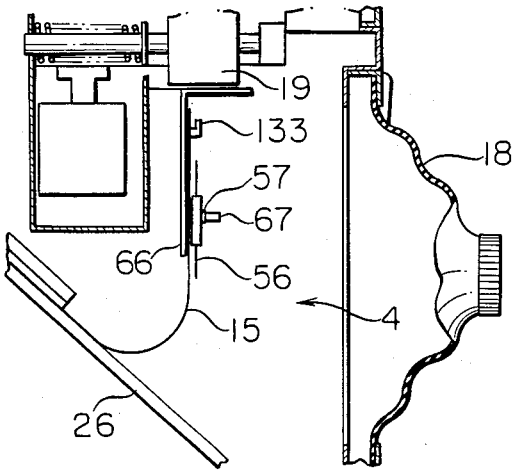

FIG. 42 shows an arrangement in which a film positioning pin 67 is attached to the support plate 66, in addition to the carrier means set pin 133. The film positioning pin 67 projects from the carrier means 15 when the latter is fitted about the pin 67 and the disk film 56 is also fitted thereabout so that the fitting of the film is facilitated.

Figure 43:
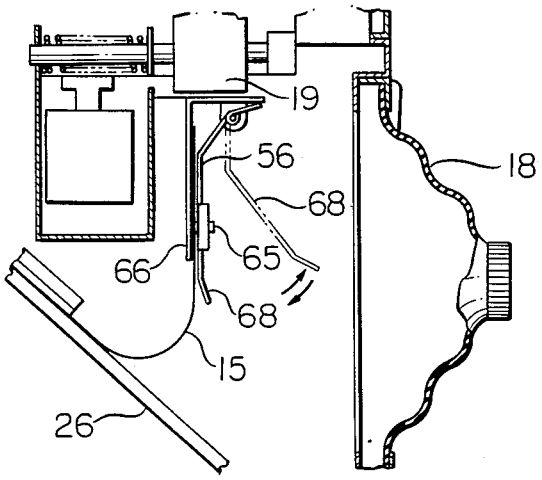

FIG. 43 shows the provision of a carrier means holding spring 68 on the support plate 66. In the case of setting the disk film 56, the carrier means holding spring 68 is drawn up to the imaginary line and the carrier means 15 is applied to the support plate 66. Then, when the carrier means holding spring 68 is released, the carrier means 15 is retained by the support plate 66 due to the force of the spring 68.

Figure 44:
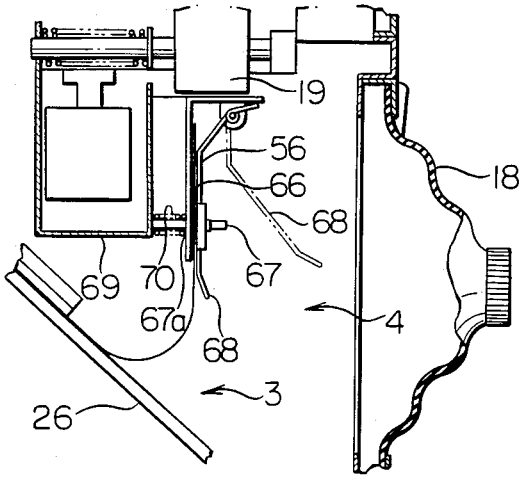

FIG. 44 shows an embodiment in which the film positioning pin 67 is movably fixed to the support plate 66. That is, the pin 67 is caused to pass through the support plate 66 and a bracket 69 of a holder receiving member and is removably supported by means of a compressed spring 70 inserted between the bracket 69 and an engaging section 67*a* formed with the pin 67.

Consequently, the carrier means 15 is retained by the support plate 66 by means of the carrier means holding spring 68 and when the disk film 56 is attached to the carrier means 15, the film is fitted about the film positioning pin 67 projecting from the carrier means 15.

Upon completion of the fitting operation of the disk film 56, the film positioning pin 67 is thrusted against the spring 70 so that, for example, it engages a stopper (not shown) and is held without projecting outwards from the support plate 66.

Consequently, when the disk film 56 is carried, the film positioning pin 67 does not interfere with the transfer of the film thereby facilitating the operation.

Although the instant embodiment has been described with respect to a case in which the disk film supply section 3 and the roll film supply section 2 are separated from each other, the instant embodiment can be applied to another case in which the both films may be carried from the common supply section and the instant embodiment can also be applied to a photographic material processing unit adopted to process disk films only.

Next, an embodiment in which a disk film and a roll film are carried from the same supply section will be described.

Figure 45:
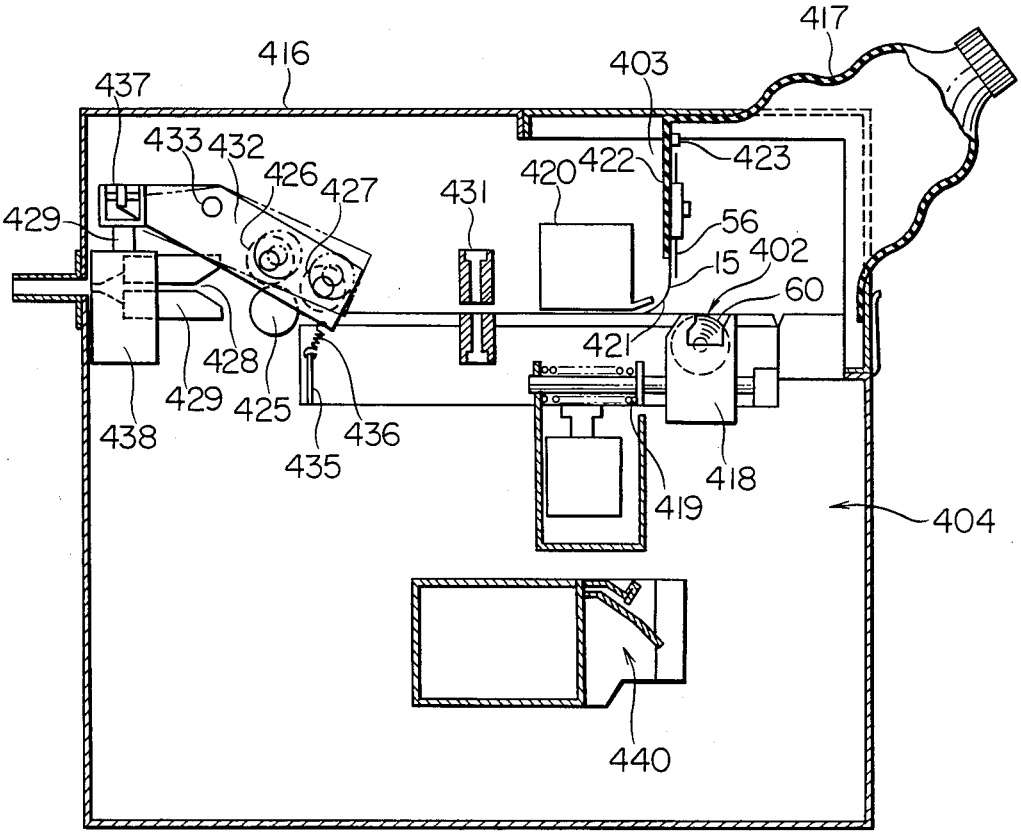
FIG. 45 is a view showing a photographic material supply section formed such that a roll and a disk film are carried into a processing tank through the same inlet port.
Figure 46:
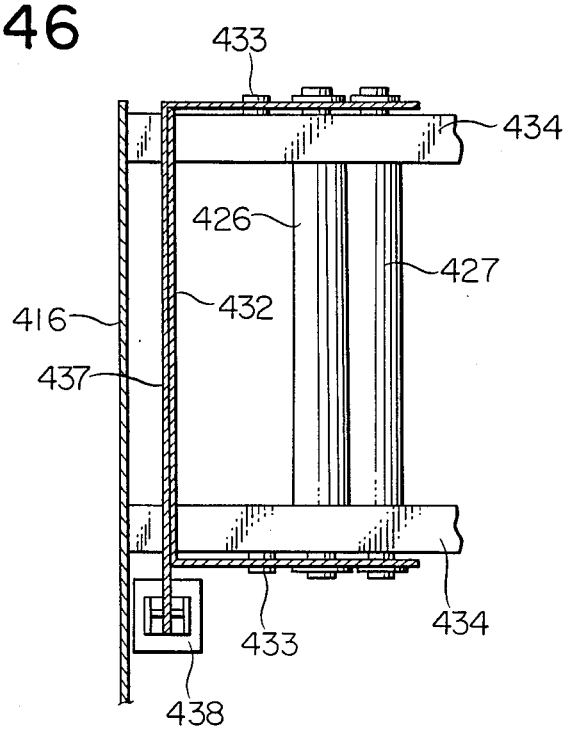
FIG. 46 is a partial view showing a portion near a pressure roller section shown in FIG. 45.

A photographic material supply section 404 is arranged in a set box 416 as shown in FIGS. 45 and 46. The set box 416 is provided with a dark bag 417. A holder receiving member 418 of a roll film supply section 402 is so arranged as to move horizontally through a spring 419 and in front of the member 418 there is formed a carrier means inserting path 421 which extends from between the section 402 and a film cutter section 420 to the conveying mechanism 13.

A support plate 422 of a disk film support section 403 is fixed to the set box 416 and an engaging pin 423 for stopping the carrier means 15 is provided on the support plate 422.

The film cutter section 420 cuts the terminating end of the roll film 60 when the roll film is carried and the holder receiving member 418 is drawn up to a predetermined position against the spring 419 through a film packaging member (not shown).

In front of the film cutter section 420 there are arranged three pressure rollers 425, 426 and 427 capable of compressing the roll film 60 and an insert guide 429 having an inlet port 428. On an inserting path 421 there is provided a sensor 431 for detecting the passing of the films.

The sensor 431 comprises a plurality of sensing members arranged in the traverse direction to the inserting path 421 so that the sensor can distinguish from the width and the length of the carried film whether the carried film is the roll film or the disk film.

The pressure rollers 426 and 427 which lie above the carrier means inserting path 421 are mounted on a movable arm 432 acting as a releasing means which is rotatably supported with a shaft 433 on a bracket 434 fixed to the set box 416. Further, between one end of the movable arm 432 and a stationary pin 435 there is arranged a return spring 436 which urges the pressure rolelr 426 disposed upper side of the carrier means inserting path 421 against the lower pressure roller 425 under a predetermined load so that the entry of light into the inlet port 428 is prevented.

The other end of the movable arm 432 is coupled to a movable shaft 439 of a solenoid 438 through a coupling member 437. The solenoid 438 operates when the sensor 431 detects the passing of the disk film 56, the movable arm 432 is rotated counter-clockwise to raise the pressure rolelrs 426 and 427 forming a clearance from the pressure roller 425 so that the disk film 56 can pass through the clearance.

Further, the sensor 431 comprises a timing member capable of adjusting a time period when the solenoid 438 have been actuated, so that the pressrue roller 428 is raised up right before the arrival of the disk film 56 and is lowered to the original position right after the leaving of the disk film 56.

Next, the operation of the instant embodiment will be described.

For example, in case the disk film shown in FIG. 19 is processed, the fitting means 57 is prepared and the support shaft 58*b* of the receiving member 58 is inserted into the disk film fitting hole 15*d* of the carrier means 15 by hands through the dark bag.

Then the fore end of the carrier means 15 is inserted into the carrier means inserting hole 421 and the engaging hole 15*b* with which the sprocket 335 comes into engagment at the time of carrying the carrier means 15 is set by the engaging pin 423.

Next, the disk film 56 is taken out from for example, its package and the fitting hole 56*c* of the disk film 56 is fitted about the support shaft 58*b*. Then the engaging projection 59*b* of the stop member 59 is brought into engagement with the engaging hole 58*c* of the support shaft 58*b* and the disk film 56 is attached to the carrier means 15.

Upon completion of setting the disk film 56, the carrier means 15 is disengaged from the engaging pin 423 by hand and inserted into the carrier means insert path 421. In this case, the sensor 431 distinguishes the disk film 56 from the size, solenoid 438 operates to rotate the movable arm 439 counterclockwise which raises the pressure rollers 426 and 427 forming clearance from the pressure roller 425 so that the disk film 56 passes through the clearance smoothly.

When the disk film passes over the pressure roller 425, the movable arm 432 returns to its original stage by the action of the return spring 436 preventing the entry of light into the processing section from outside.

The fore end of the carrier means 15 is guided by, for example, the upper guides 351 of the conveying mechanism shown in FIG. 34 and the engaging holes 15*b* of the carrier means 15 comes into engagement with the carrier means sprockets 335 whereby the carrier means 15 is automatically drawn into the processing tank, carried by the sprockets 335 of the intermediate rollers 331 and 332 and the lower roller 333, caused to return by being guided by the lower guides 351 at the lower roller 333 and carried into the next processing tank from the upper guides 351.

The carrier means 15 is conveyed in the same manner in the processing tank in the next step thereby processing the film.

Next, in case the roll film 60 is processed, the receiving member 58 of the fitting means 57 and the stop member 59 are removed and only the roll film 60 is attached to the carrier means 15 shown in FIG. 40 which is then set in the roll film supply section 402 so as to be carried.

In this case, the sensor 431 distinguishes the roll film 60 from the size, then the solenoid 438 does not operate.

Accordingly, the roll film 60 passes between the pressure roller 425 and the pressure rollers 426 and 427 and is carried from the inlet port 428 for processing.

In case the carrier means 15 attached with both the roll film 60 and the disk film 56 simultaneously, the sensor 431 detects firstly the disk film and then controlls the solenoid 438 to be actuated during the passing of the disk film 56 through the pressure rollers.

Thereafter, the pressrue rollers 426 and 427 are returned to their original state, thereby pressing the roll film 60 to prevent the entry of light into the processing section.

Abovementioned operation of the pressure rollers also can be attained by another sensing function of the sensor 431 which can detect the fore end and the rear end of the carrier means 15, so that the pressure rollers 426 and 427 are raised up during the passing of the carrier means 15.

In case that a plurality of the disk films 56 are attached to the carrier means 56 as shown in FIG. 18 and further the roll films 60 are attached at the rear end of the carrier means simultaneously, this sensing fucntion detecting the force and rear end of the carrier means 15 is preferred.

As described above, the photographic material processing unit according to the present invention has various advantages in that since it is provided with a photographic material supply section from which a disk film and a roll film are carried into the processing tank through the same inlet port, the unit can be more miniaturized and the photogrpahic material carrying operation is facilitated.

What is claimed is:

1. A unit for processing photographic material comprising at least one tank adapted to contain a processing solution;

a conveying means for conveying said material in a direction along a path into contact with said solution, said conveying means having a carrier member adapted to convey a roll film and a disk film along said path;

a supply means for supplying said material to said conveying means; and a delivery means for deliverying said material after processing;

wherein said carrier member comprises a flexible sheet member and a fitting member, said sheet member adapted to convey said disk film and said roll film thereon and said fitting member adapted to fit said disk film and said roll film on the sheet member.

2. The processing unit of claim 1 wherein said roll film can be fitted at a rear side of said sheet member relative to said carrying direction and said disk can be fitted in front of said roll film on said sheet member relative to said carrying direction.

3. The processing unit of claim 2, wherein said carrier member has an engaging slot on said sheet member and said path is formed in a conveying mechanism having an conveying sprocket capable of engaging with said engaging slot so that said conveying mechanism can convey said carrier member along said path.

4. The processing unit of claim 3, wherein said conveying mechanism is so arranged in said tank that said carrier member can pass in the processing solution with the disk film and the roll film.

5. The processing unit of claim 4, wherein said path forms a common path capable of allowing both the disk film and the roll film to pass therethrough.

6. The processing unit of claim 5, wherein said supply means comprises a common supply section capable of fitting both the roll film and the disk film at the predetermined position on said carrier means, whereby, when both the roll film and the disk film are fitted on said same carrier member simultaneously, said processing unit can process the disk film and the roll film simultaneously, and when the roll film and the disk film are fitted selectively on said carrier means, said processing unit can process the disk film and the roll film selectively.

7. The processing unit of claim 6, wherein, said unit further comprises a squeezing means for squeezing the roll film to remove the processing solution adhered on the roll film, and a releasing mechanism for allowing the disk film to pass said squeezing means without the squeezing operation in said common path.

8. The processing unit of claim 7, wherein said unit further comprises a sensor means for detecting a carried film, distinguishing whether the carried film is the disk film or the roll film and controlling said releasing mechanism so that the squeezing operation is released while the disk film passes through said squeezing means.

9. The processing unit of claim 6, wherein said tank has an opening for allowing both the disk film and the roll film to pass therethrough from said supply means to said conveying means, wherein said common supply section has a light shielding means comprising a pressing roller for pressing the roll film to prevent light from entering into said opening, whereby said light shielding means can release said pressing roller from the pressing operation while the disk film passes through said pressing roller.

10. The processing unit of claim 4, wherein said path comprises a first path for the roll film and a second path for the disk film.

11. The processing unit of claim 10, wherein said supply means comprises a common supply section capable of fitting both the roll film and the disk film at the predetermined position on said carrier means, whereby, when both the roll film and the disk film are fitted on said same carrier member simultaneously, said processing unit can processes the disk film and the roll film simultaneously while carrying the disk film and the roll film along respective path, and when the roll film and the disk film are fitted selectively on said carrier means, said processing unit can process the disk film and the roll film selectively while carrying either one of the disk film or the roll film on respective path.

12. The processing unit of claim 4, wherein said fitting members comprises a first fitting element for fitting the disk film and a second fitting element for fitting the roll film on said body member.

13. The processing unit of claim 12, wherein said disk film has a through hole at a center portion thereof, and wherein said first fitting element comprises an engaging portion capable of passing through said through hole, thereby fitting the disk film onto said body member.

14. The processing unit of claim 4, wherein said carrier member further comprises a circulating means for circulating the processing solution to the disk film.

15. The processing unit of claim 14, wherein said circulating means comprises an opening being a through hole passing through said sheet member for allowing the processing solution to flow through said sheet member, said opening is so arranged at the fitting position of the disk film that the processing solution can process a fitted side of the disk film fitted to said body member.

16. The processing unit of claim 4, wherein said coveying mechanism is vertically disposed in said tank, wherein said path forms an introducing path and a discharging path at a upper portion of said conveying mechanism and forms a lower turning path at lower end thereof, and wherein there is so provided a guide means at said lower turning path that, when the disk film is carried on said carrier member in a predetermined manner, said guide means does not guide the disk film, while the disk film is carried deviating from said path, said deviated disk film is guided by said guide means.

17. The processing unit of claim 16, wherein said processing unit comprises a plurality of said tanks having said conveying mechanism therein respectively, wherein there is provided a cross over passage between said introducing path of one of said tanks and said discharging path of another one of said tanks, and wherein, when said conveying mechanism conveys a plurality of said carrier member simultaneously, said cross over passage is so arranged that one of said carrier member being discharged and another one of said carrier member being introduced are not interfered with each other.

18. The processing unit of claim 13 wherein said sheet member has a fitting hole being a through hole, and wherein said first fitting element comprises a setting member and a receiving member thereon, said receiving member has an engaging portion capable of passing through both said through hole of the disk film and said fitting hole of said sheet member and then coupling with said setting member, whereby said first fitting element can fix the disk film and said sheet member between said receiving member and said setting member, and said first fitting element can be removed from said sheet member while being not in use.

* * * * *